United States Patent [19]

Santoni

[11] 4,101,156

[45] Jul. 18, 1978

[54] CLAMPING RING FOR REMOVABLE COVERS OF DRUMS

[75] Inventor: Cesar Santoni, Hamilton, Canada

[73] Assignee: Greif Bros. Corporation, Delaware, Ohio

[21] Appl. No.: 690,941

[22] Filed: May 28, 1976

[51] Int. Cl.[2] ..... E05C 19/18

[52] U.S. Cl. ..... 292/256.69

[58] Field of Search ..... 292/256.69, 307, 318, 292/322, 320, 256.6

[56] References Cited

U.S. PATENT DOCUMENTS

| | | | |
|---|---|---|---|
| 2,304,539 | 12/1942 | Carpenter | 292/256.69 X |
| 2,772,109 | 11/1956 | Busch et al. | 292/307 R |
| 2,914,354 | 11/1959 | Moberg | 292/307 R |
| 3,146,012 | 8/1964 | King, Sr. | 292/320 |
| 3,339,961 | 9/1967 | Schaefer | 292/256.69 |
| 3,768,848 | 10/1973 | Santoni | 292/256.69 |

*Primary Examiner*—Richard E. Moore

*Attorney, Agent, or Firm*—Kane, Dalsimer, Kane, Sullivan and Kurucz

[57] ABSTRACT

A clamping ring for securing a removable cover on a drum is provided with a closing device having a lever and a latch. The lever is pivotal in a plane parallel to that of the clamping ring from an outwardly extending open position inwardly to contract the ring into a closed position. The latch is pivoted downwardly until its latch finger extends through a slot in the lever finger to place the clamping ring in a sealed position. This sealed position is accomplished by means of a primary lock caused by the interengagement of a hook-tang on the latch finger and bottom surfaces of the lever finger adjacent the slot. A secondary lock is formed by the interengagement of an inwardly projecting tang on the latch finger which also engages with surfaces of the lever finger adjacent the slot.

7 Claims, 11 Drawing Figures

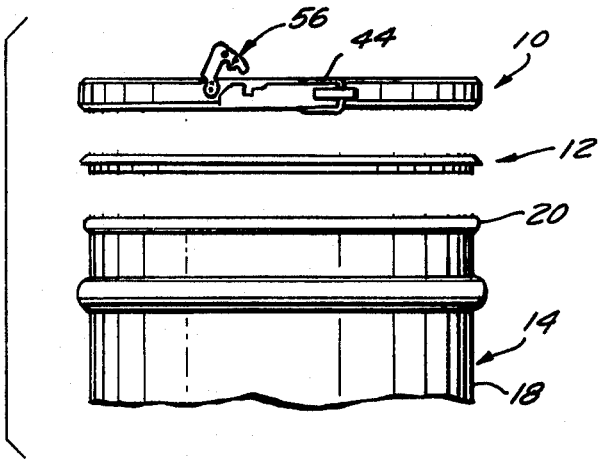
FIG. 1
FIG. 3
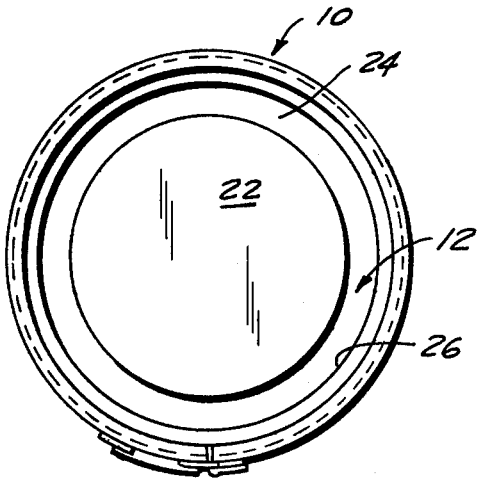
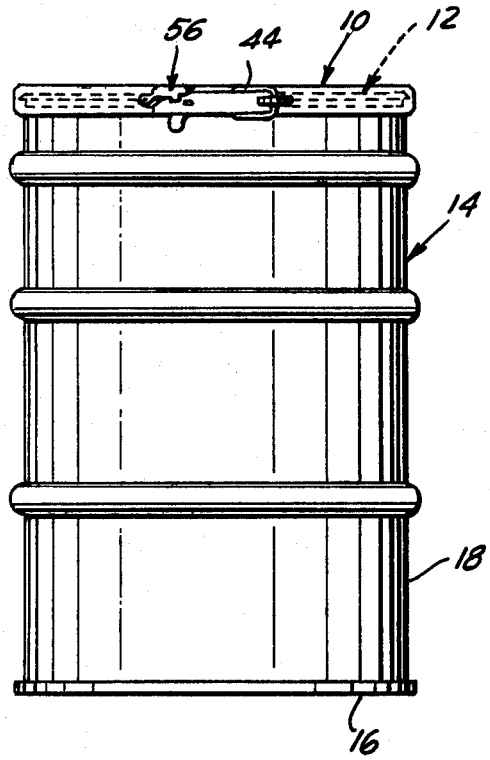
FIG. 2
FIG. 4
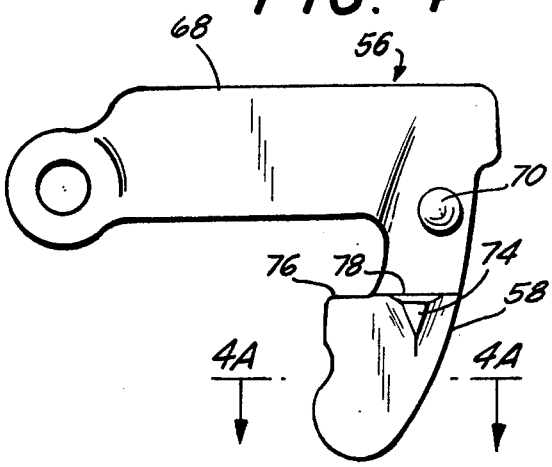
FIG. 4A
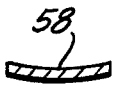

FIG. 7
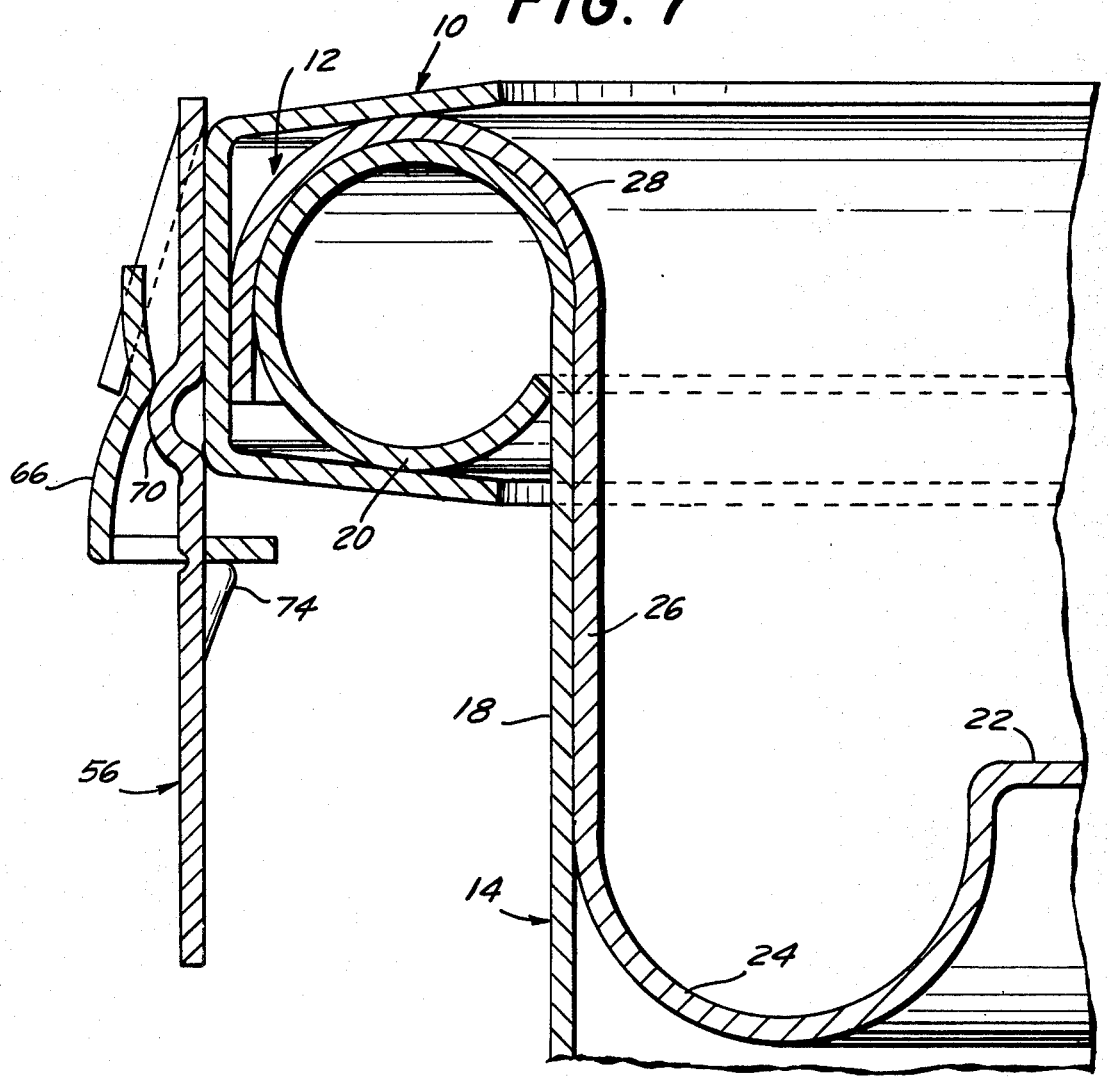
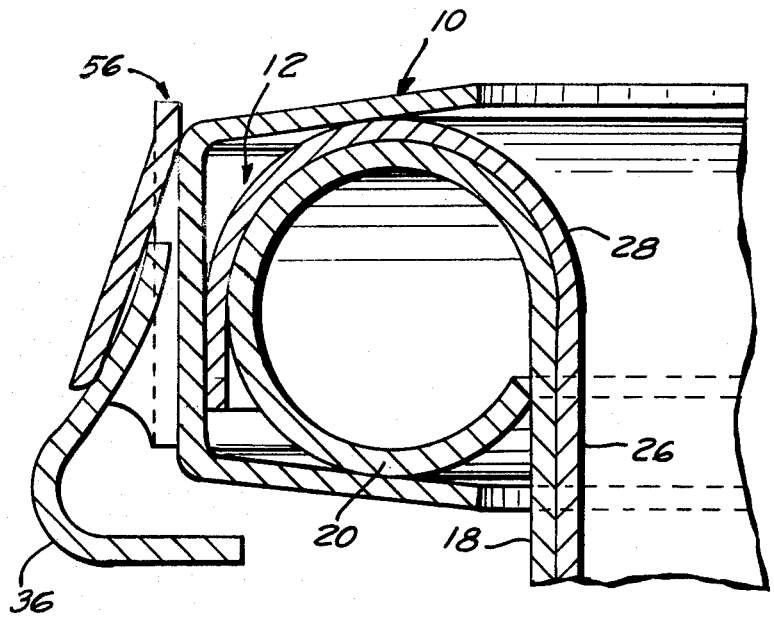
FIG. 8

CLAMPING RING FOR REMOVABLE COVERS OF DRUMS

BACKGROUND OF THE INVENTION

There are a number of version of clamping rings that have been proposed in the literature for releasably securing a lid or closure on a drum or container and have been offered commercially in the past or are currently available and marketed. One form includes a cooperating lever and latch. In actual use, here is concern over disengagement of the lever or latch or both during handling, shipping or storage. Furthermore, it is conventional to provide little eyelets as a part of the latch and lever so that a sealing wire may aid in securing the parts against opening due to vibration and also provide visible and physical assurance to the recipient of such containers that the contents have not been tampered.

The present invention has application to the foregoing clamping rings and particularly the clamping ring disclosed in U.S. Pat. No. 3,768,848, granted Oct. 30, 1973. This clamping ring includes a lever which is swung in plane parallel to that of the top drum rim or clamping ring. A latch is adapted to swing downwardly to engage with the lever, and, therefore, gravity helps to maintain the latch in a closed position. This type of latch is also provided with an eyelet in the end of the latch finger for accommodating a twisted wire or plastic type loop seal to prevent a drum from being opened accidently or or intentionally for pilferage of contents or for other unauthorized removal, particularly when such drums are being utilized for storing, handling and transporting of valuable products of a variety of types, including precious metals.

In this connection, one end of the wire is attached to the body of the seal and the other end is passed or looped through the eyelet of the latch and lever and then through the channel of the seal where the tab or the loose end is permanently impressed to complete the sealing process. This ensures that the latch and lever cannot be disengaged without first breaking the material used to form the looped portion of the seal.

SUMMARY OF THE INVENTION

With the above background in mind, it is among the primary objectives of the present invention to provide an improved lever and latch type of clamping ring that positively locks when it is closed and can only be opened by bending and breaking off a tab. The presence of this tab assures the container recipient that it has not been opened. The removal of the tab permits the latch to be released whereby the cover can be removed from the container. This clamping ring is particularly useful on drums and containers utilized in the shipment of precious metals and other valuable materials which must be carefully protected against pilferage.

A further object of this invention is to eliminate the necessity of using a wire or other type seal with a clamping ring as has been customarily employed heretofore.

These and other objects and advantages are achieved by a clamping ring utilizing a latch designed to form three essentially simultaneous locks with a lever. The first lock occurs when a button or dimple on the outer face of the latch engages in the inner slot of the lever when the latch is pivoted downwardly to pass a projecting finger at the base of the latch through a slot of the lever. The second lock is activated when a hook-tang on the inner curved section of the latch finger and ledged portion of the bottom half of the lever frontally engage following insertion of the latch finger into the lever slot. The third lock is effectuated when a projecting tang or prong located on the inner surface of the bottom half of the latching finger engages with the inside edge of the base of the slot in the lever. The latch finger is scored in the middle to permit the bottom half to be broken off by pressing inwardly or outwardly and twisting. The removal of the lower end of the finger serves as an indication that the seal has been broken and access may have been had to the container contents. When the seal is broken, the dimple in the latch finger serves to maintain the latch and lever in a closed position.

With the above objectives among others in mind, reference is had to the attached drawings.

BRIEF DESCRIPTION OF THE DRAWINGS

In the drawings:

FIG. 1 is an exploded fragmentary front elevational view of a drum, cover and clamping ring incorporating the teachings of the present invention;

FIG. 2 is a front elevational view of the drum, cover and clamping ring in assembled position;

FIG. 3 is a top plan view of the assembled drum, closure and clamping ring;

FIG. 4 is an enlarged plan view of the latch portion of the assembly of the invention;

FIG. 4A is a cross-sectional view taken along the line 4A—4A of FIG. 4;

FIG. 7 is an end sectional view thereof taken along the plane of lines 7—7 of FIG. 6;

FIG. 8 is an end sectional view thereof taken along the plane of lines 8—8 of FIG. 6;

DESCRIPTION OF THE PREFERRED EMBODIMENT

Figure 5:
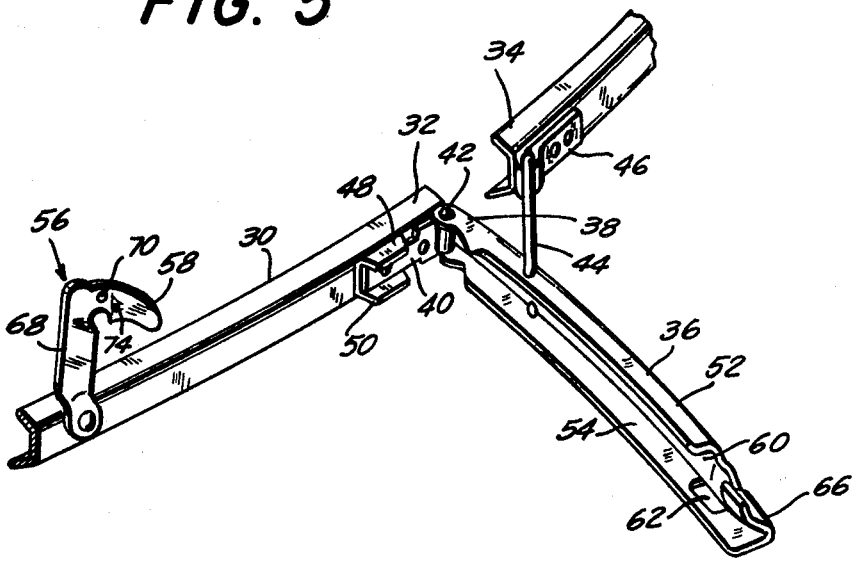
FIG. 5 is a fragmentary perspective view of the clamping ring with latch and locking lever in an open position.

In the form of the invention illustrated in FIG. 1, the improved clamping ring 10 serves to releasably close the metal cover 12 across the top opening of the drum or container 14 which may be fabricated of metal, fiber or plastic or a combination thereof. In a typical metal drum a metal bottom closure 16 is permanently sealed and secured to the lower peripheral edge of the tubular body 18. The tubular body 18 is open at its upper end and includes a chime portion defined by an outwardly turned substantially tubular bead 20 which serves to support the peripheral portion of cover 12. The cover 12 is generally made of sheet metal and may assume anyone of many conventional designs in which a central disc-shaped portion 22 extends into one or more circular reinforcing ribs 24 having an upwardly depending cylindrical apron 26 adapted to nest with or engage the inner wall of the upper end of the tubular body 18. A concavo-convex peripheral flange 28 extends from the upper part of the skirt 26 and is adapted to rest upon the tubular bead 20 of the chime of the container 14. Obviously, other bead and chime constructions are contemplated by this invention including both outwardly and inwardly extending tubular beads.

The drum or container and cover assembly heretofore described are representative of many forms of construction well known to the art and trade; and the drum as well as cover may be formed of sheet steel, aluminum, convolutely or spirally wound laminated layers of kraft board, fiber or the like, reinforced plastics or combinations of fiber and metal or fiber or metal having coatings or linings therein.

Referring now to the improved clamping ring 10, a split ring 30 made of suitable resilient metal such as steel is provided with a locking mechanism connected between ends 32 and 34 whereby the ring may be expanded to permit its assembly around the cover 12 and drum 14 or contracted to tightly engage the assembled cover and container in holding the cover in place over the top of the drum 14 in a manner well known in the art. The locking mechanism to which the present invention applies, may assume many different forms and configurations as, for example, that shown in the above identified patent as well as those known to the trade. In the examplary locking mechanism illustrated in the drawings, a locking lever 36 is pivoted or hinged at its base end 38 to a hinge strap 40 by means of pin 42. This hinge strap 40 is suitably connected and secured to end 32 of the split ring 30. The locking lever 36 is also pivotally connected at an intermediate point to link 44 which is pivotally connected to hinge strap 46 connected to the other ring end 34. Thus, when the lever 36 is pivoted outwardly relative to the split ring 30, the ring is expanded to permit its assembly about the combined cover 12 and drum 14; and when the lever is pivoted inwardly and eventually into engagement with the split ring 30, the ring is contracted to exert a compressive and holding force about the assembled cover and drum.

In order to assure the proper relationship of the lever 36 and the split ring 30 as the lever is being pivoted to its locking position, the hinge strap 40 is provided with outwardly extending or upturned edge guides or flanges 48 and 50. These guides advantageously nest or are disposed between the spaced flanges 52 and 54, respectively. When this relationship occurs, the locking lever 36 is in its proper closed position and any upwardly or downwardly directed force or pressure on the locking lever will cause its flanges to engage with these guides.

A latch 56 may be shiftable, either upwardly or downwardly, as suggested in the above identified patent, to lock the free end of the lever 36. In the examplary embodiment illustrated herein, the latch 56 is pivotedly mounted on the split ring 30 between an upwardly extending unlocked position to a horizontal locking position. Toward this end, the latch 56 is formed with latch finger 58 which will engage with the outer free end of the lever 36 to retain the latter in a locked position. The lever 36 also includes a cut-out portion 60 and an accommodating slot 62 which is positioned to receive latch finger 58 when the latch 56 is in a horizontal or closed position. The latch 56 further maintains lever 36 in a locked position through the disposition of finger 66 of the lever within the pocket 68 defined by outwardly projecting surfaces of the latch 56. In order to maintain the latch 56 in its horizontal position at which the lever 36 is locked, an outwardly projecting dimple or bead 70 is adapted to be received in and engage with an accommodating recess 72 formed on the inner face of the free end of the lever 36 to cause a tight frictional engagement between these surfaces.

Additional locking and sealing surfaces are formed on latch 56 which also provide visual indicator means that the cover may have been removed and access may have been obtained to the container contents for pilpherage purposes. Below dimple 70 on locking finger 58 is a secondary locking tang 74 in the form of a triangular projection. When the latch is seated within the slot 62 in the lever, the curvature or arc of the latch finger causes the tang 74 to snap in under the inside edge of the base of the slot 62 thereby locking the latch in position. A third lock and seal which may be considered a primary lock takes place when the hook or tang 76 on the inner curved section of the top half of the latch finger 58 and the ledged portion 54 on the bottom half of lever 36 frontly engage when the hook 76 catches in the base of lever 36. These two locking engagements which occur between lever 36 and primary tang 76 and secondary tangs 74 as finger 58 is passed through notch 62 operate to prevent premature opening of clamping ring 10. The tang engagements are facilitated by both end and side springing of finger 58 which is effected by the curvature or arc of the latch finger.

The latch finger 58 is provided with a weakened zone or score 78 in the middle to permit the bottom half to be broken off by pressing inwardly and/or outwardly and twisting. When the seal is broken in this manner, the dimple 70 in the latch finger 58 still holds the lock in the same manner as the latch in the above referenced patent. An inserting tool, either manual or pneumatic, can be provided to press the latch through the slot in lever 36 to attain the locked and sealed position. A screwdriver or similar tool may normally be used to break the bottom half of the seal at the score mark.

Figure 10:
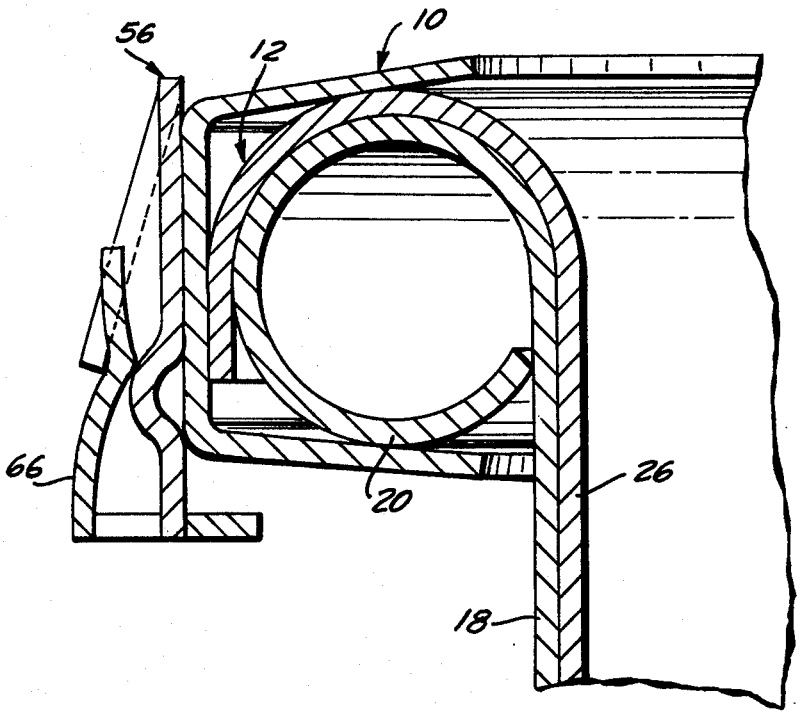
FIG. 10 is a sectional end view thereof taken along the plane of lines 10—10 of FIG. 9.
Figure 6:
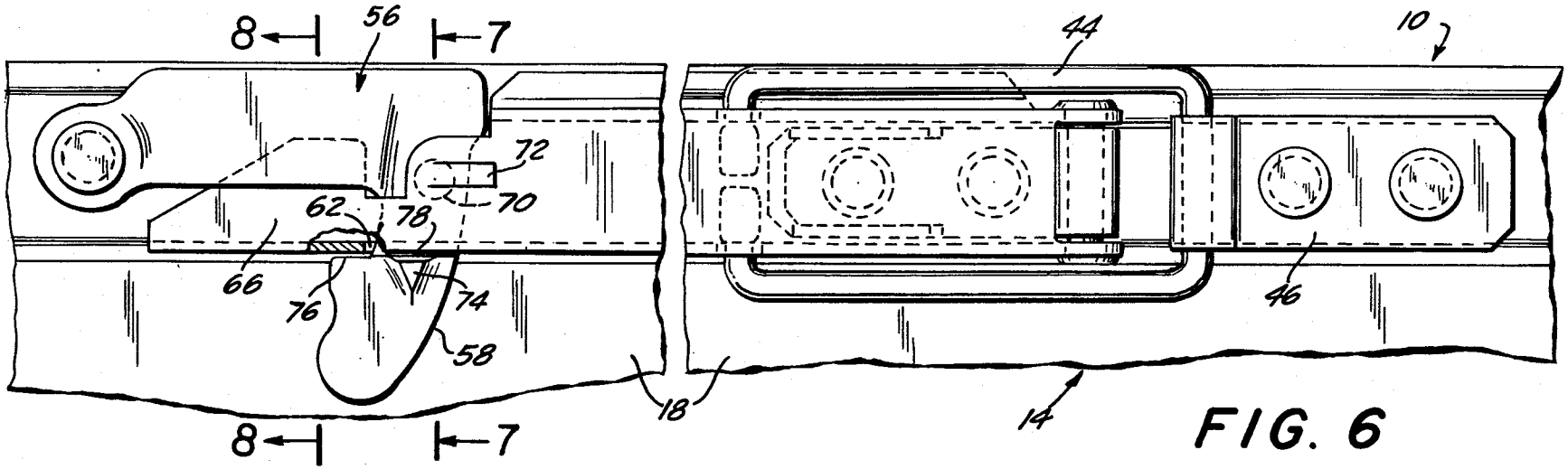
FIG. 6 is an enlarged fragmentary front elevational view of the locking mechanism of the clamping ring.
Figure 9:
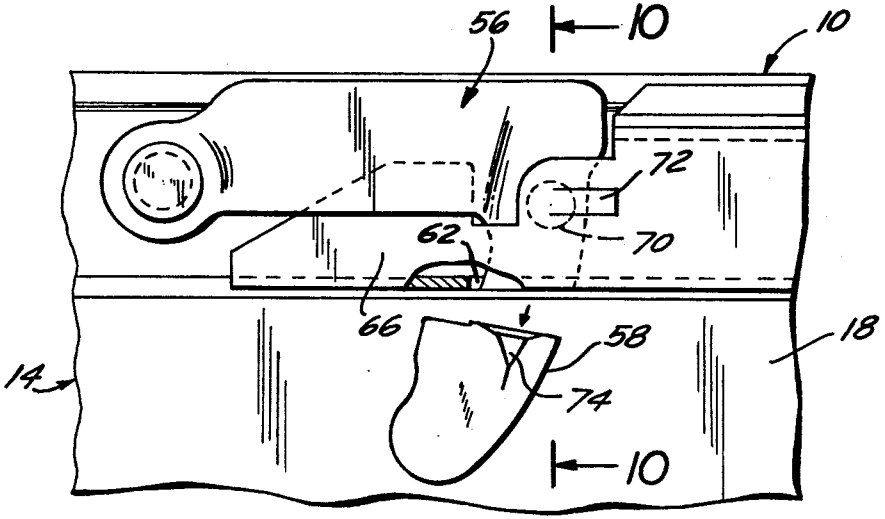
FIG. 9 is an enlarged fragmentary front elevation view of the locking mechanism of the clamping ring with the sealing segment removed.

Thus, it will be evident that when the cover 12 is initially applied to the open end of the drum 14, the clamping ring 10 is assembled around the cover flange 28 and the chime bead 20 of the drum 14 while the locking lever 36 is in its outwardly extending open position. Thereafter, the lever 36 is pivoted inwardly toward the split ring 30 to contract the locking ring causing the inwardly extending ring flanges to engage with the associated surfaces of the cover flange 28 and chime bead 20 until a tight locking relationship is attained. The proper relationship of the locking lever 36 is maintained relative to the split ring 30 and is also assured when the lever is shifted from its open to locked position through the cooperation and interengagement of the hinge strap guides or flanges 46 and 50 and associated surfaces of flanges 52 and 54, respectively, of the lever 36. Thereafter, the latch 56 is pivoted downwardly until the latch finger 58 extends through the slot 62 and the lever finger 66 extends into the latch pocket 68. This movement actuates the three locking and sealing arrangements between the latch 56 and the lever 36. Primary tang 76 seats in position on the under surface of flange 54 of lever 36. Secondary tang 74 seats under the rear bottom edge of notch 62 and dimple 70 seats in accommodating recess 72 on the lever 36. The result is a sealed and locked clamping ring 10 through the interengagement of surfaces of the lever 36 and latch 56. FIGS. 6 through 8 depict the locked and sealed relationship prior to breaking off of the lower portion of finger 58. Opening of the clamping ring 10 and the container can only be achieved by breaking off the lower portion of finger 58 at the score mark 78. At that time, the sealed relationship is destroyed, however, the latch is releasably maintained in position by means of the interengagement between latch dimple 70 and the accommodating recess 72 on lever 36 as depicted in FIGS. 9 and 10.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. An improved clamp ring for use in releasably holding a cover in assembled relationship with a drum comprising:

a split ring having two ends positioned substantially adjacent to one another;

a locking lever pivotedly connected adjacent one of its ends with one of the ends of the split ring;

said lever having a slot therein;

linkage means for pivotally connecting the other end of the split ring with an intermediate portion of the locking lever;

the pivotal connections being so constructed and arranged that the locking lever is shiftable from an open position away from the split ring at which the split ring is in an expanded position to a locking position adjacent surfaces of the split ring at which the split ring is in a contracted position;

a latch pivotally mounted on said split ring being in the form of a base terminating in a finger whereby the latch is adapted to be pivoted downwardly until the finger extends through the slot in the lever and adapted to be shifted from an unlatched position away from the split ring to a latched position in interengagement with the lever when the lever is in its locked position;

removable sealing means including an arcuately shaped finger portion on the latch adapted to automatically engage with surfaces on the lever when the latch is shifted to seal the latch in latched position and positioned so that removal thereof will permit shifting of the latch between the latched and unlatched positions; and said sealing means including the arcuately shaped portion of the finger terminating in a hook tang position to interengage with the under surface of the lever adjacent the slot through which the finger extends, and further including a second lock formed by an arcuate portion of the latch finger terminating in an inwardly laterally projecting tang adapted to interengage with the surfaces adjacent the slot of the lever when the finger extends therethrough.

2. The invention in accordance with claim 1 wherein a weakened zone is provided on the latch finger above the first and second tang so that upon introduction of sufficient force the portion of the finger below the weakened zone can be removed thereby breaking the seal.

3. The invention in accordance with claim 2 wherein a dimple projects from the latch finger above the weakened zone for interengagement with a receiving recess on the lever when the latch is in the latched position, the dimple cooperating with the cooperating recess to provide latching surfaces for the clamping ring after the portion of the finger below the score mark has been removed.

4. The invention in accordance with claim 1 wherein a hinge strap is bent back upon itself to form a pivot bearing connected to said one end of the split ring and the locking lever is hingedly connected at the bearing.

5. The invention in accordance with claim 4 wherein guide means is provided and is comprised of projecting and interengaging surfaces which cooperate in guiding the lever from its open to locking position and in maintaining the lever in such locking position, the guide means comprising spaced flanges on the locking lever and flanges on the hinge strap spaced apart less than the lever flanges so that the strap flanges are interposed and nested between and in proximity with the lever flanges when the lever is in its locking position, whereby any upwardly or downwardly directed force and pressure on the lever will cause its flanges to engage with the flanges of the strap.

6. The invention in accordance with claim 1 wherein the pivotal connections are disposed at right angles to the plane of the split ring so that the locking lever is substantially and essentially in the same plane as the split ring, and the pivotal connection of the latch is disposed at right angles to the split ring so that the latch is shiftable in a plane normal to the plane of the split ring and is adapted to be shifted to a position essentisally in the plane of the split ring when latching the lever in its locking position.

7. The invention in accordance with claim 1 wherein the locking lever has a depending finger and the latch an accommodating pocket for receiving and engaging with the lever finger in cooperating to retain the lever in its locked position.

* * * * *